US012317993B2

(12) United States Patent
Zhong et al.

(10) Patent No.: US 12,317,993 B2
(45) Date of Patent: Jun. 3, 2025

(54) PULL-OUT TABLE WITH SINGLE SLIDE RAIL

(71) Applicant: Yotrio Group Co., Ltd., Linhai (CN)

(72) Inventors: Zhan Zhong, Linhai (CN); Jianqiang Xie, Linhai (CN)

(73) Assignee: Yotrio Group Co., Ltd., Linhai (CN)

( * ) Notice: Subject to any disclaimer, the term of this patent is extended or adjusted under 35 U.S.C. 154(b) by 139 days.

(21) Appl. No.: 18/220,268

(22) Filed: Jul. 11, 2023

(65) Prior Publication Data

US 2024/0285066 A1 Aug. 29, 2024

(51) Int. Cl.

| | |
|---|---|
| ***A47B 1/05*** | (2006.01) |
| ***A47B 1/02*** | (2006.01) |
| ***A47B 1/10*** | (2006.01) |

(52) U.S. Cl.

CPC ..... *A47B 1/05* (2013.01); *A47B 1/02* (2013.01); *A47B 1/10* (2013.01); *A47B 2001/025* (2013.01)

(58) Field of Classification Search

CPC .... A47B 1/08; A47B 1/10; A47B 1/02; A47B 2001/053; A47B 2001/025

See application file for complete search history.

(56) References Cited

U.S. PATENT DOCUMENTS

| | | | | | |
|---|---|---|---|---|---|
| 2,743,977 | A * | 5/1956 | Norquist | A47B 1/05 | 108/74 |
| 3,059,981 | A * | 10/1962 | Bcllomo | A47B 1/02 | 108/85 |
| 3,911,835 | A * | 10/1975 | Schill | A47B 1/10 | 108/87 |
| 4,061,091 | A * | 12/1977 | Goyvaerts | A47B 1/05 | 108/84 |
| 5,735,220 | A * | 4/1998 | Wang | A47B 1/10 | 108/87 |
| 9,622,568 | B1 * | 4/2017 | Lin | A47B 13/081 | |
| 11,793,303 | B1 * | 10/2023 | Chen | A47B 1/10 | |
| 2017/0156489 | A1 * | 6/2017 | Tippmann | A47B 1/10 | |
| 2021/0227968 | A1 * | 7/2021 | Togni | A47B 1/10 | |
| 2022/0287450 | A1 * | 9/2022 | Benard | A47B 1/08 | |

FOREIGN PATENT DOCUMENTS

| | | | | |
|---|---|---|---|---|
| DE | 4402561 C1 * | 4/1995 | | A47B 1/05 |

* cited by examiner

*Primary Examiner* — Daniel J Rohrhoff

(74) *Attorney, Agent, or Firm* — Jingming (James) Cai; SAC Attorneys LLP

(57) ABSTRACT

A pull-out table with a single slide rail including a table frame, first and second table boards symmetrically disposed on the table frame, an extended table board disposed between the first and second table boards, and a sliding rail assembly, is provided. The sliding rail assembly including rope winding wheels is disposed on an inner frame on one side of the table frame along a length of the table frame. The rope winding wheel on one end of the inner frame is cooperatively linked to the rope winding wheel on the other end of the inner frame through a synchronously wound steel rope. The first and second table boards are respectively connected to an upper part and a lower part of the steel rope through respective slider seats. When one of the table boards is pulled, the other table board is driven to move in an opposite direction.

5 Claims, 4 Drawing Sheets

PULL-OUT TABLE WITH SINGLE SLIDE RAIL

CROSS-REFERENCE TO RELATED APPLICATIONS

This application claims priority to and the benefit of the patent application titled "A pull-out table with single slide rail", application number 2023203045085, filed in the China National Intellectual Property Administration on Feb. 24, 2023. The specification of the above-referenced patent application is incorporated herein by reference in its entirety.

FIELD OF THE INVENTION

The present invention, in general, relates to furniture and fixtures, and in particular, relates to a pull-out table with a single slide rail.

BACKGROUND

A pull-out table is typically used to reduce space occupied by the table when the table is not in use and to adjust a board area of the table. A table board of a conventional pull-out table is typically divided into two halves. An extended table board positioned in the middle of the two halves of the table board can be folded downward and stored below the table board when the two halves of the table board are pulled on two sides of the pull-out table.

Conventional pull-out tables with such structures typically require two sliding rails on a left side and a right side of the table to allow synchronous pulling of the two halves of the table board on two sides. However, using two sliding rails not only increases cost, but also causes unsmooth pulling of the two halves of the table board. In addition, conventional pull-out tables with sliding rails require substantial manufacturing precision.

SUMMARY OF THE INVENTION

To address the above-recited problems, the present invention provides a pull-out table with a single slide rail, which reduces cost and allows smoother drawing and extension of its table board by replacing conventional bilateral slide rails with a steel rope, rope winding wheels, and slider seats. The pull-out table with the single slide rail disclosed herein comprises a table frame, a first table board, a second table board, an extended table board, and a sliding rail assembly. The first table board and the second table board are symmetrically disposed on the table frame. The extended table board is disposed between the first table board and the second table board. The sliding rail assembly is disposed on an inner frame on one side of the table frame along a length of the table frame. The sliding rail assembly comprises a rope winding wheel disposed on each of the two ends of the inner frame. The rope winding wheel on one end of the inner frame is cooperatively linked to the rope winding wheel on the other end of the inner frame through a synchronously wound steel rope. The steel rope is synchronously wound around the rope winding wheel on each of the two ends of the inner frame. The steel rope is connected to the first table board or the second table board through a slider seat. The first table board and the second table board are respectively connected to an upper part and a lower part of the steel rope. When one of the table boards is pulled, the other table board is driven to move in an opposite direction.

In an embodiment, the sliding rail assembly further comprises a guide rail disposed on the inner frame on the one side of the table frame. The slider seat disposed on a bottom surface of each of the first table board and the second table board is configured to move within the guide rail.

In an embodiment, the pull-out table further comprises a chute disposed on an inner frame on the other side of the table frame opposite to the sliding rail assembly. In an embodiment, the pull-out table further comprises a slider disposed on the bottom surface of each of the first table board and the second table board. The slider is configured to move back and forth to match movement of the sliding rail assembly along the chute, to assist in joining or separating the first table board and the second table board.

In an embodiment, the pull-out table further comprises a stopper disposed on each of the two ends of the chute. The stopper is configured to limit a stroke of the slider.

In an embodiment, the extended table board is configured as a turnover table board comprising a first turnover table board and a second turnover table board. The first turnover table board is connected to the second turnover table board via a central hinge.

In an embodiment, the first turnover table board and the second turnover table board of the extended table board are fixed to the table frame through hinges. The hinges are disposed on corresponding crosspieces in the table frame.

The present invention has the following advantages:

(1) The sliding rail assembly disposed on the inner frame on one side of the table frame along the length of the table frame, drives the first table board and the second table board to move in opposite directions, thereby causing the first table board and the second table board to join or separate. The two sliding rails of conventional pull-out tables are replaced by a steel rope, rope winding wheels, and slider seats in the present invention, to reduce the cost and allow the table board to be smoothly pulled out and extended.

(2) The slider provided at the bottom of each of the first table board and the second table board and configured to match the chute that is disposed on the inner frame, slides in the chute to assist in linear sliding of the first table board and the second table board, so that the cost and manufacturing difficulty are reduced, and extending or pulling smoothness of the pull-out table is improved.

(3) The hinging of the first turnover table board and the second turnover table board of the extended table board allows folding of the extended table board. The size of the extended table board, after folding, is further reduced, which avoids the impact of the extended table board on a telescopic movement of the first table board and the second table board, while reducing the space occupied by the pull-out table.

In the figures: 100—pull-out table, 1—table frame, 2—first table board, 3—second table board, 4—extended table board, 41—first turnover table board, 42—second turnover table board, 43—hinge, 5—chute, 6—slider, 7—sliding rail assembly, 71—steel rope, 72—rope winding wheel, 73—slider seat, 8—stopper, 11—crosspiece, and 12—hinge.

DETAILED DESCRIPTION OF THE INVENTION

A pull-out table with a single slide rail of the present invention is further described below with reference to the drawings.

Figure 1:
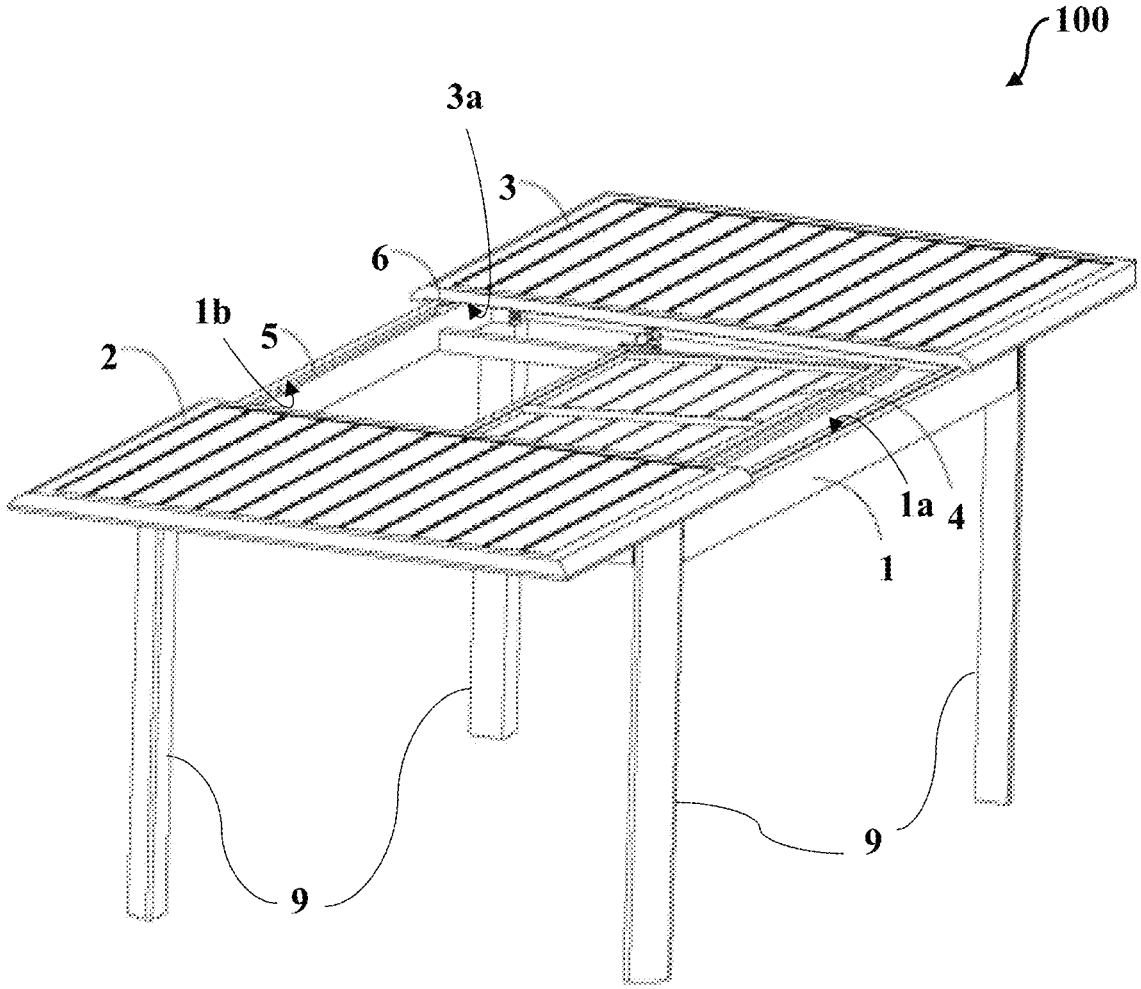
FIG. 1 is a structural diagram of a pull-out table with a single slide rail.
Figure 2:
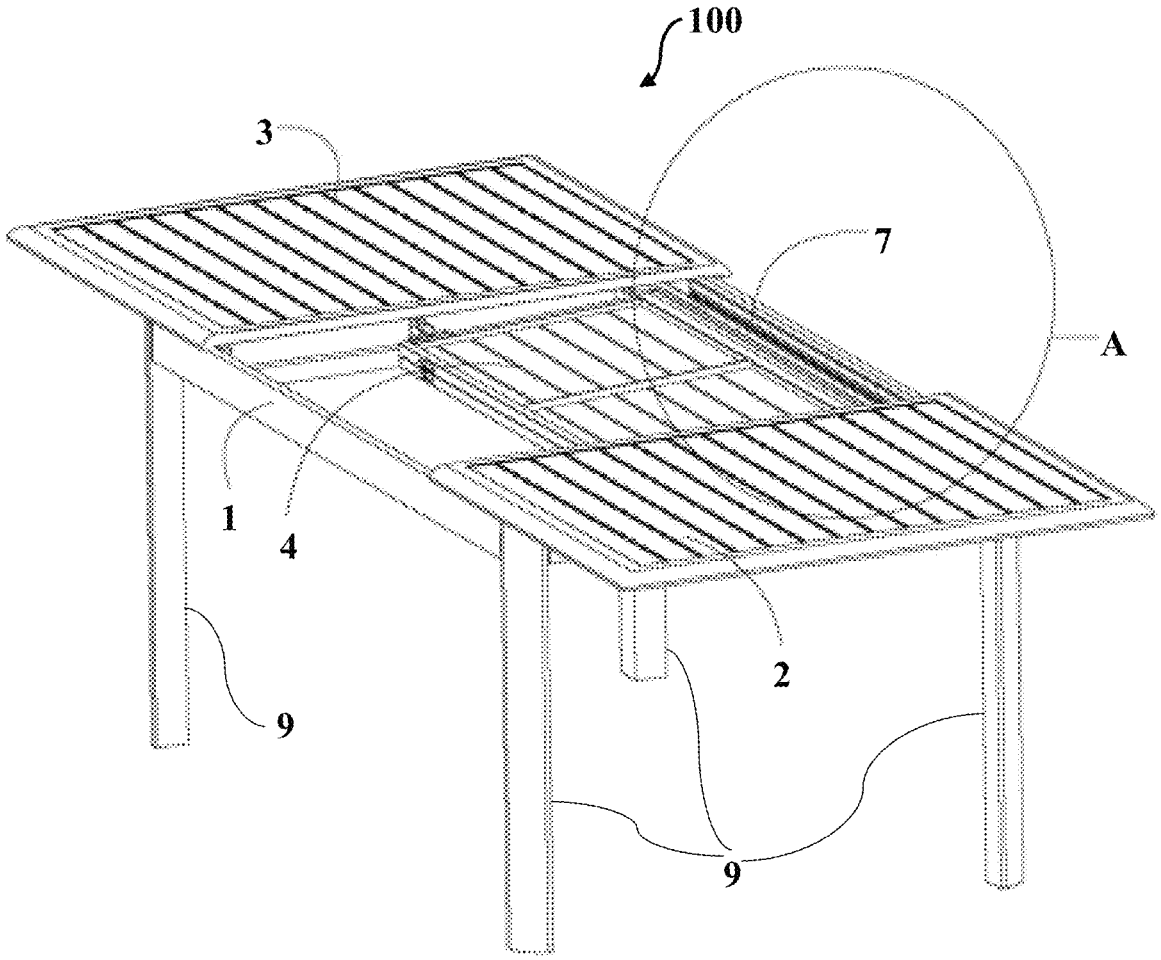
FIG. 2 is another structural diagram of the pull-out table with the single slide rail.
Figure 3:
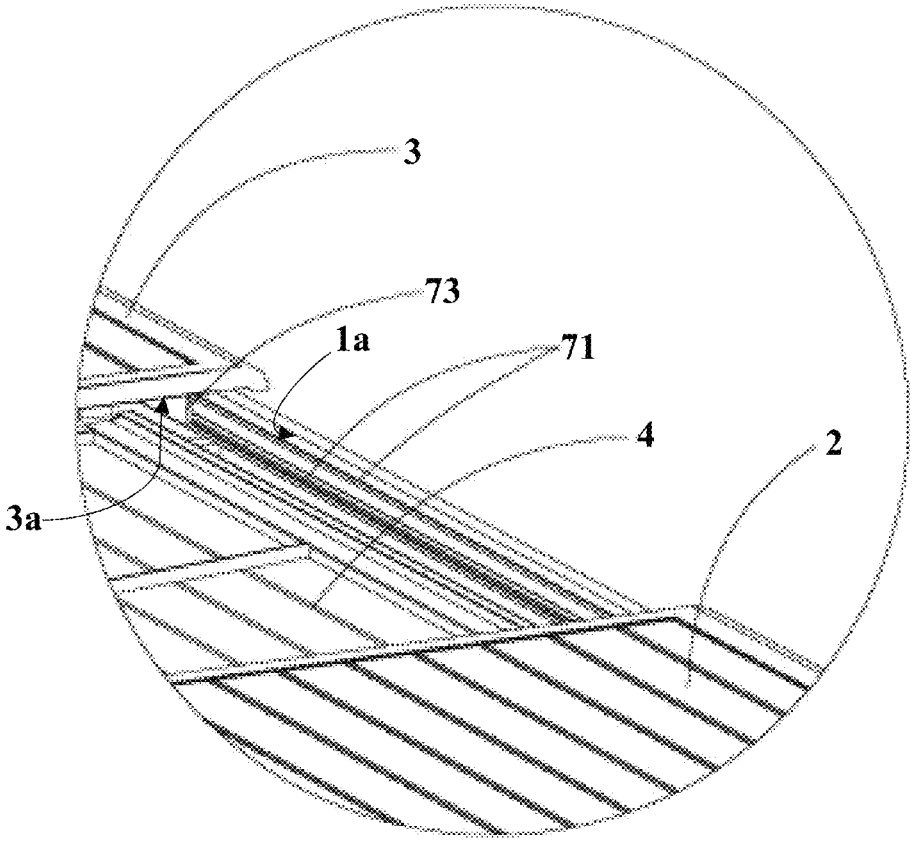
FIG. 3 is an enlarged view of a portion marked A in FIG. 2 of the pull-out table with the single slide rail.
Figure 4:
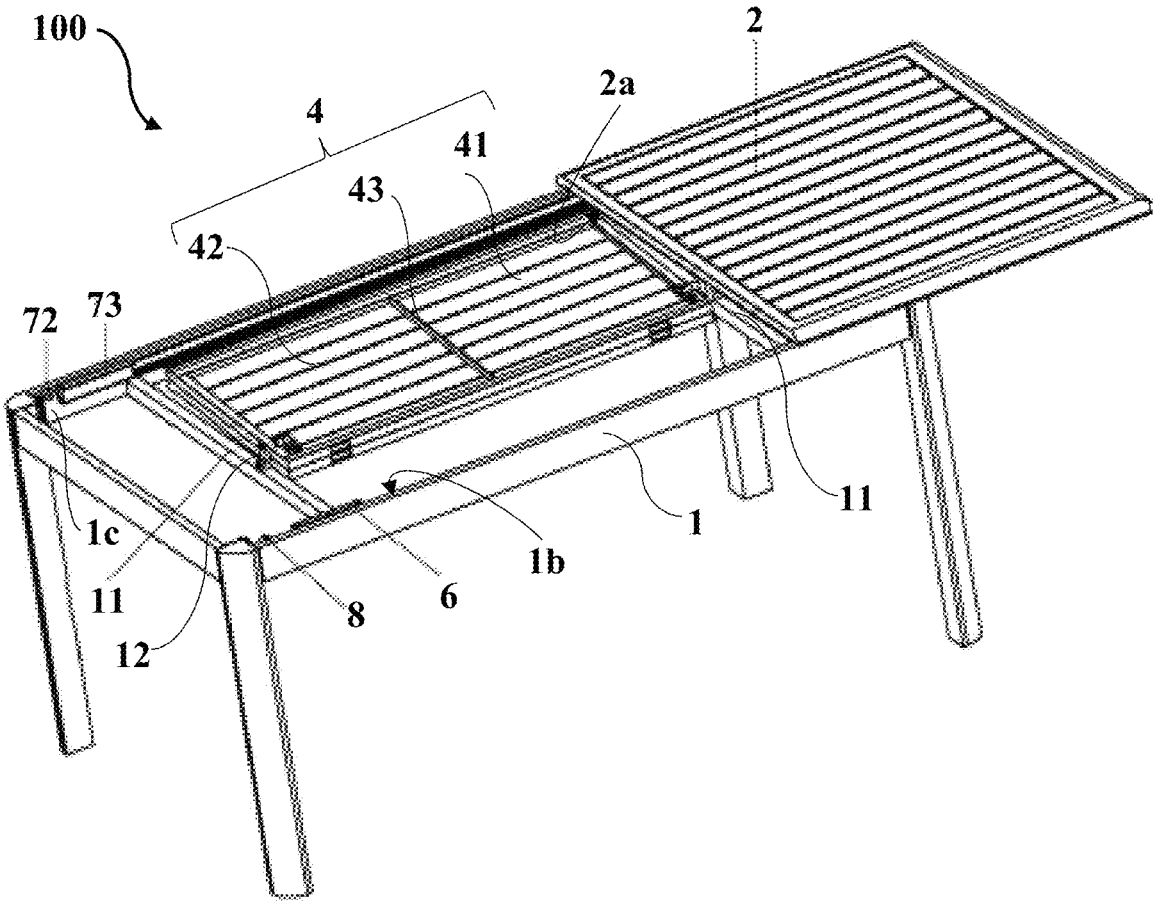
FIG. 4 is a structural diagram of the pull-out table with the single slide rail, excluding the second table board.
Figure 5:
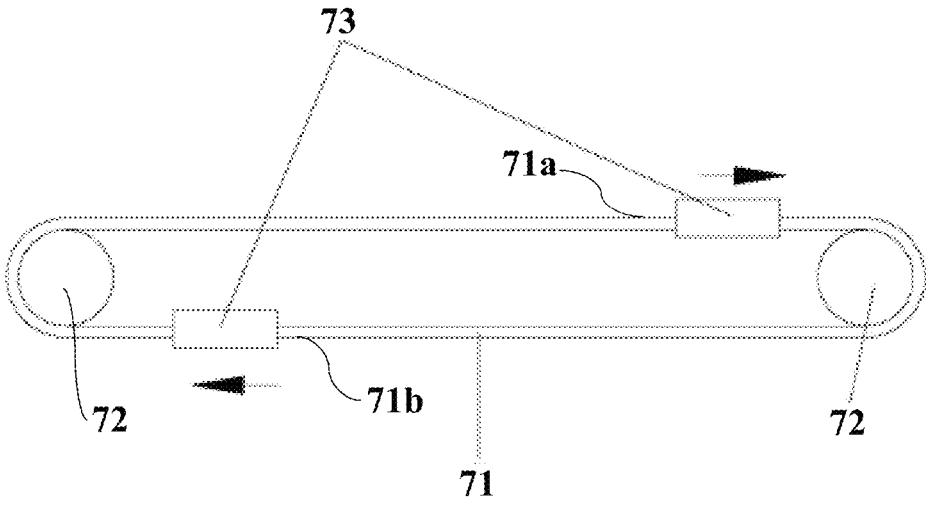
FIG. 5 is an elevation view of a sliding rail assembly of the pull-out table with the single slide rail, showing operation of the sliding rail assembly.

As shown in FIG. 1 to FIG. 4, the pull-out table 100 with the single slide rail comprises a table frame 1, two sliding table boards 2 and 3, an extended table board 4, and a sliding rail assembly 7. The bottom of the table frame 1 is provided with table legs 9 as shown in FIG. 1 and FIG. 2. The extended table board 4 is disposed between the two sliding table boards 2 and 3. The sliding table boards comprise a first table board 2 and a second table board 3. The first table board 2 and the second table board 3 are symmetrically disposed on the table frame 1. The sliding rail assembly 7 is disposed on an inner frame 1*a* on one side of the table frame 1 along a length of the table frame 1. The sliding rail assembly 7 comprises a rope winding wheel 72 disposed on each of the two ends of the inner frame 1*a*. The rope winding wheel 72 on one end 1*c* of the inner frame 1*a* shown in FIG. 4, is cooperatively linked to the rope winding wheel 72 on the other end of the inner frame 1*a* through a synchronously wound steel rope 71 as shown in FIG. 5. The steel rope 71 is connected to the first table board 2 or the second table board 3 through a slider seat 73. The slider seat 73 is disposed on a bottom surface 2*a* of the first table board 2 shown in FIG. 4, and to a bottom surface 3*a* of the second table board 3 as shown in FIG. 3. One slider seat 73 is fixed to the upper part 71*a* of the steel rope 71 and the other slider seat 73 is fixed to the lower part 71*b* of the steel rope 71 as shown in FIG. 5. The first table board 2 and the second table board 3 are respectively connected to the upper part 71*a* and the lower part 71*b* of the steel rope 71. The second table board 3 is driven to move in the opposite direction when the first table board 2 is pulled, or the first table board 2 is driven to move in the opposite direction when the second table board 3 is pulled. In an embodiment, the sliding rail assembly 7 further comprises a guide rail disposed on the inner frame 1*a* on the one side of the table frame 1. The slider seat 73 at the bottom of each of the first table board 2 and the second table board 3 is configured to move within the guide rail.

The pull-out table 100 further comprises a chute 5 disposed on an inner frame 1*b* on the other side relative to the sliding rail assembly 7. That is, the chute 5 is disposed on the inner frame 1*b* on the other side of the table frame 1 opposite to the sliding rail assembly 7. The pull-out table 100 further comprises a slider 6 disposed on each of the bottom surfaces 2*a* and 3*a* of the first table board 2 and the second table board 3, respectively, as shown in FIG. 1 and FIG. 4. The slider 6 is configured to move back and forth to match movement of the sliding rail assembly 7 along the chute 5, to drive the first table board 2 and the second table board 3 to be joined or separated. As shown in FIG. 4, the pull-out table 100 further comprises a stopper 8 disposed on each of the two ends of the chute 5. The stopper 8 is configured to limit a stroke of the slider 6. When sliding in the chute 5, the slider 6 assists in linear sliding of the first table board 2 and the second table board 3, so that the cost and manufacturing difficulty are reduced and the pulling smoothness of the pull-out table 100 is improved.

In an embodiment, the extended table board 4 is configured as a turnover table board comprising a first turnover table board 41 and a second turnover table board 42 as shown in FIG. 4. The first turnover table board 41 and the second turnover table board 42 are hinged in the middle. That is, the first turnover table board 41 is connected to the second turnover table board 42 via a central hinge 43 as shown in FIG. 4. The first turnover table board 41 and the second turnover table board 42 are fixed to the table frame 1 through hinges 12. The hinges 12 are disposed on corresponding crosspieces 11 in the table frame 1 as shown in FIG. 4. The crosspieces 11 are arranged along a width of the table frame 1.

As shown in FIG. 5, for a specific use, to expand the usable area of the pull-out table 100, a user can pull the first table board 2 and/or the second table board 3. When the user pulls the first table board 2 and/or the second table board 3, the steel rope 71 drives the slider seat 73 to move in the opposite direction, and further drives the first table board 2 to be separated from the second table board 3, so that the extended table board 4 can be rotated to a position between the first table board 2 and the second table board 3 from below the table frame 1. The user can then fasten the first table board 2, the extended table board 4, and the second table board 3 mutually together using fasteners. To reduce the usable area, the user can rotate the extended table board 4 to make the extended table board 4 sink below the table frame 1, and can then push the first table board 2 and/or the second table board 3. When the user pushes the first table board 2 and/or the second table board 3, the steel rope 71 drives the slider seat 73 to move in the opposite direction until the first table board 2 and the second table board 3 are joined.

The present invention precludes the need to remove the extended table board 4 from the table frame 1 or place another extended table board 4 in the table frame 1, which is convenient when there is a need to expand the usable area of the pull-out table 100.

When cost is not a concern, the sliding rail assembly 7 can be arranged on the two inner frames 1*a* and 1*b* of the table frame 1 along the length of the table frame 1, without the chute 5 and the slider 6.

It shall be noted that the above embodiments have been provided only for illustrating the technical scheme of the present invention and not to limit the present invention. Although the present invention has been described with reference to the above embodiments, those ordinarily skilled in the art should understand that they can still modify the technical scheme recorded in the foregoing embodiments, or perform equivalent replacements on some or all of the technical features; however, such modifications or replacements do not separate the essence of technical schemes from the substance and scope of the technical schemes provided by the embodiments of the present invention.

We claim:

1. A pull-out table with a single slide rail comprising:

a table frame;

a first table board and a second table board symmetrically disposed on the table frame;

an extended table board disposed between the first table board and the second table board;

a sliding rail assembly disposed on an inner frame on one side of the table frame along a length of the table frame, wherein the sliding rail assembly comprises:

a rope winding wheel disposed on each of two ends of the inner frame, wherein the rope winding wheel on one of the two ends of the inner frame is cooperatively linked to the rope winding wheel on another one of the two ends of the inner frame through a steel rope, wherein the steel rope is synchronously wound around the rope winding wheel on the each of the two ends of the inner frame, wherein the steel rope is connected to one of the first table board and the second table board through a slider seat, wherein the first table board and the second table board are respectively connected to an upper part and a lower part of the steel rope, and wherein, when one of the first table board and the second table board is pulled, another one of the first table board and the second table board moves in an opposite direction;

a chute disposed on an inner frame on another side of the table frame opposite to the sliding rail assembly; and a slider disposed on the bottom surface of the each of the first table board and the second table board, wherein the slider is configured to move back and forth to match movement of the sliding rail assembly along the chute, for assisting in one of joining and separating the first table board and the second table board.

2. The pull-out table with the single slide rail according to claim 1, wherein the sliding rail assembly further comprises a guide rail disposed on the inner frame on the one side of the table frame, wherein the slider seat disposed on a bottom surface of each of the first table board and the second table board is configured to move within the guide rail.

3. The pull-out table with the single slide rail according to claim 1, further comprising a stopper disposed on each of two ends of the chute, wherein the stopper is configured to limit a stroke of the slider.

4. The pull-out table with the single slide rail according to claim 1, wherein the extended table board is configured as a turnover table board comprising a first turnover table board and a second turnover table board, wherein the first turnover table board is connected to the second turnover table board via a central hinge.

5. The pull-out table with the single slide rail according to claim 4, wherein the first turnover table board and the second turnover table board are fixed to the table frame through hinges, wherein the hinges are disposed on corresponding crosspieces in the table frame.

* * * * *